US006756725B2

(12) United States Patent
Yoo et al.

(10) Patent No.: US 6,756,725 B2
(45) Date of Patent: Jun. 29, 2004

(54) CATHODE RAY TUBE WITH TENSION MASK

(75) Inventors: Jung-In Yoo, Seoul (KR); Do-Hun Pyun, Suwon (KR); Jun-Kyo In, Suwon (KR); Won-Ho Kim, Yongin (KR)

(73) Assignee: Samsung SDI Co., Ltd., Suwon (KR)

( * ) Notice: Subject to any disclaimer, the term of this patent is extended or adjusted under 35 U.S.C. 154(b) by 114 days.

(21) Appl. No.: 10/080,402

(22) Filed: Feb. 25, 2002

(65) Prior Publication Data

US 2003/0111951 A1 Jun. 19, 2003

(30) Foreign Application Priority Data

Mar. 27, 2001 (KR) ..... 2001-15951

(51) Int. Cl.[7] ..... H01J 29/80

(52) U.S. Cl. ..... 313/407; 313/402; 313/404; 313/408

(58) Field of Search ..... 313/402, 404, 313/407, 408

(56) References Cited

U.S. PATENT DOCUMENTS 5,099,169 A 3/1992 Vriens
5,111,107 A 5/1992 Kume et al.
5,170,102 A 12/1992 Sluyterman et al.
5,889,362 A 3/1999 Barten
6,420,054 B1 * 7/2002 Cozar et al. ..... 313/402

FOREIGN PATENT DOCUMENTS

KR 1991-10602 6/1991

* cited by examiner

*Primary Examiner*—Vip Patel
(74) *Attorney, Agent, or Firm*—Robert E. Bushnell, Esq.

(57) ABSTRACT

A cathode ray tube includes a panel with a substantially flat outer surface and an inner curved surface. The inner curved surface of the panel has a phosphor screen. A funnel is connected to the panel while externally mounting a deflection unit for deflecting electron beams. A neck is connected to the funnel while internally mounting an electron gun for emitting the electron beams. A color selection apparatus is internally fitted to the panel such that the electron beams land on correct phosphors of the phosphor screen. The panel has an effective screen with short and long axis. The panel bears a first thickness Th at the ends of the effective screen in the long axis direction, and a second thickness Tv at the ends of the effective screen in the short axis direction. The second thickness Tv of the panel is established to be larger than the first thickness Th of the panel. The color selection apparatus has a mask with short and long axis while bearing a plurality of beam-guide holes, and a frame combined with the mask such that the mask maintains a tensioned state. The mask is tensioned in the long axis direction while being supported by the frame.

10 Claims, 6 Drawing Sheets

CATHODE RAY TUBE WITH TENSION MASK

CLAIM OF PRIORITY

This application makes reference to, incorporates the same herein, and claims all benefits accruing under 35 U.S.C. §119 from an application for CATHODE RAY TUBE HAVING A TENSIONED MASK earlier filed in the Korean Industrial Property Office on 27 Mar. 2001 and there duly assigned Ser. No. 2001-15951.

BACKGROUND OF THE INVENTION

1. Field of the Invention

The present invention relates to a cathode ray tube and, more particularly, to a cathode ray tube which has a color selection apparatus bearing a tension mask.

2. Description of the Related Art

A cathode ray tube, the most popular display device, has been developed in various formats while keeping pace with the times. Recently, a wide screen cathode ray tube has been the choice of electronic consumers.

In order to enlarge the screen size, the screen panel should be flat in consideration of the quality of the screen images displayed at the periphery of the screen.

As the panel becomes enlarged and flattened, a shadow mask for the color selection apparatus is also enlarged in size. In consideration of various difficulties related to the enlargement of the curved shadow mask such as a weak strength thereof, a new-modeled color selection apparatus has been now employed for use in the cathode ray tube.

Such a color selection apparatus has a structure where a mask with a plurality of beam-guide holes is not curved but flattened while bearing a predetermined tension. For instance, U.S. Pat. No. 5,111,107 by Kume et al. for Grid Apparatus for a Color Cathode Ray Tube which Eliminates Vibration of the Grids discloses a grid apparatus bearing such a structure.

The grid apparatus has a plurality of slender and long grid members fitted to a frame while being tensioned in the longitudinal direction (X-axis direction). The frame has a pair of support bars arranged parallel to each other, with a predetermined distance between them, and connected to the grid members, and elastic members attached to the ends of the support bars while being positioned between them.

The grid apparatus further has metallic members attached to the elastic members, and has a thermal expansion coefficient greater than that of the latter. The metallic members prevent the grid members from suffering thermal deformation during the heat treatment process.

Meanwhile, a plurality of phosphors are formed at the internal surface of the panel in the X-axis direction (in the direction of the short axis of the panel) while corresponding to the pattern of beam-guide holes formed by the grid members. A black matrix is formed between the neighboring phosphors.

However, in the above-structured cathode ray tube, when the plurality of phosphors are arranged in the above-described manner to form a phosphor screen, mis-landing of the electron beams is liable to occur at the periphery of the screen while causing deterioration in picture quality due to the color spots.

The electron beams should correctly land on the phosphors at the periphery of the screen under the influence of the vertical magnetic field component of the terrestrial magnetism. However, with the above structure, the electron beams move in the direction vertical to the X-axis direction (the direction of Y-axis), and land on the incorrect phosphors.

In order to solve such a problem, it has been suggested that the phosphors should be arranged in the direction of the long axis of the panel (or in the horizontal direction). For instance, such a cathode ray tube is disclosed in Korean Patent Publication No. 91-10602 by Yim et al. for *Color Cathode Ray Tube*, U.S. Pat. No. 5,099,169 by Vriens for *Shadow Mask Color Display Tube*, U.S. Pat. No. 5,170,102 by Sluyterman et al. for *Picture Display Device*, and U.S. Pat. No. 5,889,362 by Barten for *Color Display Tube having a Reduced Deflection Defocusing*.

However, the above patents are only related to a cathode ray tube having no tension mask.

In order to prevent miss-landing of the electron beams with the cathode ray tube bearing a tension mask, various conditions, such as the arrangement pattern of phosphors, the tensioned state of the shadow mask and the shape of the panel, should be satisfied in an appropriate manner. In this way, the resulting flat cathode ray tube can have good picture quality.

SUMMARY OF THE INVENTION

It is an object of the present invention to provide a color correction apparatus for a cathode ray tube that prevents mis-landing of electron beams at the periphery of the display screen.

It is another object of the present invention to provide a cathode ray tube that prevents possible explosion with the enlarged flat panel.

It is still another object of the present invention to provide a cathode ray tube that has a reasonable weight even with the enlarged flat panel.

These and other objects may be achieved by a cathode ray tube with the following features.

According to one aspect of the present invention, a color selection apparatus for the cathode ray tube includes a mask having a short and a long axis, and a frame combined with the mask such that the mask is kept in a tensioned state. The mask is provided with a plurality of beam-guide holes. The mask is tensioned in the long axis direction while being supported by the frame.

The mask has a plurality of strips spaced apart from each other by a predetermined distance, and real bridges disposed between the neighboring strips while being spaced apart from each other by a predetermined distance. The beam-guide holes are formed with a plurality of slots longitudinally proceeding in the long axis direction while being partitioned by the real bridges.

Alternatively, the mask may have only a plurality of strips spaced apart from each other by a predetermined distance. In this structure, the beam-guide holes are formed with single slots longitudinally proceeding in the long axis direction while being disposed between the neighboring strips.

According to another aspect of the present invention, the cathode ray tube includes a panel with a substantially flat outer surface and an inner curved surface. The inner curved surface of the panel has a phosphor screen. A funnel is connected to the panel while externally mounting a deflection unit for deflecting electron beams. A neck is connected to the funnel while internally mounting an electron gun for emitting the electron beams. A color selection apparatus is internally fitted to the panel such that the electron beams land on correct phosphors of the phosphor screen. The panel has an effective screen with a short and a long axis. The panel has a first thickness Th at the ends of the effective screen in the long axis direction, and a second thickness Tv at the ends of the effective screen in the short axis direction. The second thickness Tv of the panel is established to be larger than the first thickness Th of the panel. The color selection apparatus has a mask with a short and a long axis while having a plurality of beam-guide holes, and a frame combined with the mask such that the mask is kept in a tensioned state. The mask is tensioned in the long axis direction while being supported by the frame.

The panel has a third thickness Tc at the center of the effective screen while satisfying the following condition: $V/H \geqq 1.1$. where V(%) is $(Tv/Tc)\times 100$, and H(%) is $(Th/Tc)\times 100$.

According to still another aspect of the present invention, the cathode ray tube includes a panel with a substantially flat outer surface and an inner curved surface. The inner curved surface of the panel has a phosphor screen. A funnel is connected to the panel while externally mounting a deflection unit for deflecting electron beams. A neck is connected to the funnel while internally mounting an electron gun for emitting the electron beams. A color selection apparatus is internally fitted to the panel such that the electron beams land on correct phosphors of the phosphor screen. The phosphor screen is shaped with a short and a long axis, and the phosphors are longitudinally arranged on the phosphor screen in the long axis direction. The color selection apparatus has a mask with a plurality of beam-guide holes corresponding to the phosphors, and a frame combined with the mask such that the mask is kept tensioned in the long axis direction. The electron beams emitted from the electron gun are directed toward the phosphor screen in a line while being parallel to the short axis of the phosphor screen.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or the similar components, wherein.

DETAILED DESCRIPTION OF THE PREFERRED EMBODIMENTS

Preferred embodiments of this invention will be explained with reference to the accompanying drawings.

Figure 11:
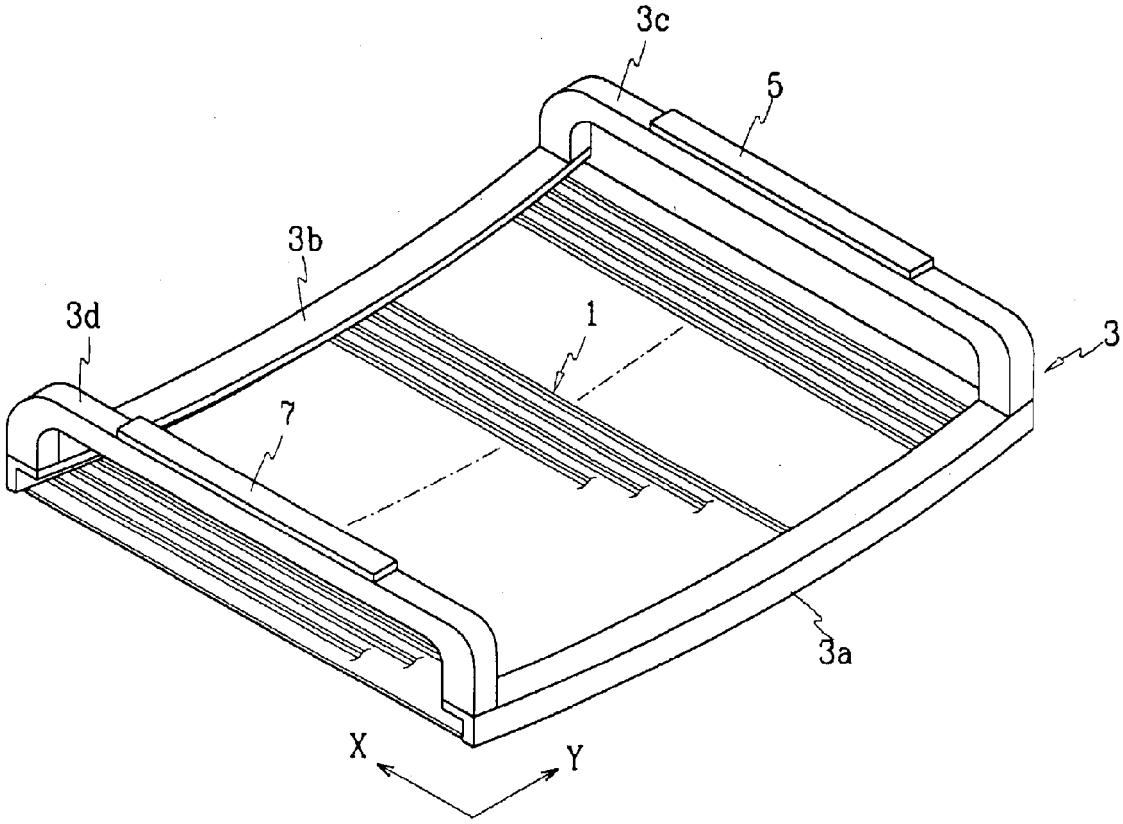
FIG.11(Prior Art)
FIG. 11 is a perspective view of a color selection apparatus for a cathode ray tube according to a related art.

As shown in FIG. 11, the grid apparatus has a plurality of slender and long grid members 1 fitted to a frame 3 while being tensioned in the longitudinal direction (in the direction of X indicated in the drawing). The frame 3 has a pair of support bars 3*a* and 3*b* arranged parallel to each other, while having a predetermined distance between them, and connected to the grid members 1, and elastic members 3*c* and 3*d* attached to the ends of the support bars 3*a* and 3*b* while being positioned between them.

The grid apparatus further has metallic members 5 and 7 attached to the elastic members 3*c* and 3*d* while having a thermal expansion coefficient greater than that of the latter. The metallic members 5 and 7 prevent the grid members 1 from suffering thermal deformation during the heat treatment process.

Figure 12:
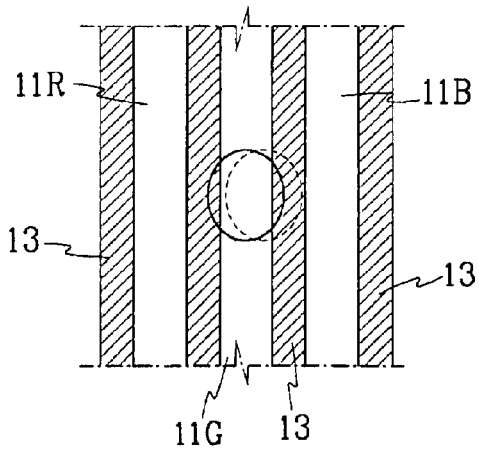
FIG.12(Prior Art)
FIG. 12 illustrates the pattern of a phosphor screen for the cathode ray tube shown in FIG. 11.

Meanwhile, as shown in FIG. 12, a plurality of phosphors 11R, 11G and 11B are formed at the internal surface of the panel in the X direction (in the direction of the short axis of the panel) while corresponding to the pattern of beam-guide holes formed by the grid members 1. A black matrix 13 is formed between the neighboring phosphors 11R and 11G, 11G and 11B, and 11R and 11B.

However, in the above-structured cathode ray tube, when the plurality of phosphors are arranged in the above-described manner to form a phosphor screen, mis-landing of the electron beams is liable to occur at the periphery of the screen while causing deterioration in picture quality due to the color spots.

The electron beams should correctly land on the phosphors 11R, 11G and 11B at the periphery of the screen under the influence of the vertical magnetic field component of the terrestrial magnetism. However, with the above structure, the electron beams move in the direction vertical to the X direction (the direction of Y indicated in the drawing), and land on the incorrect phosphors as indicated in the drawing by the dotted line.

Figure 1:
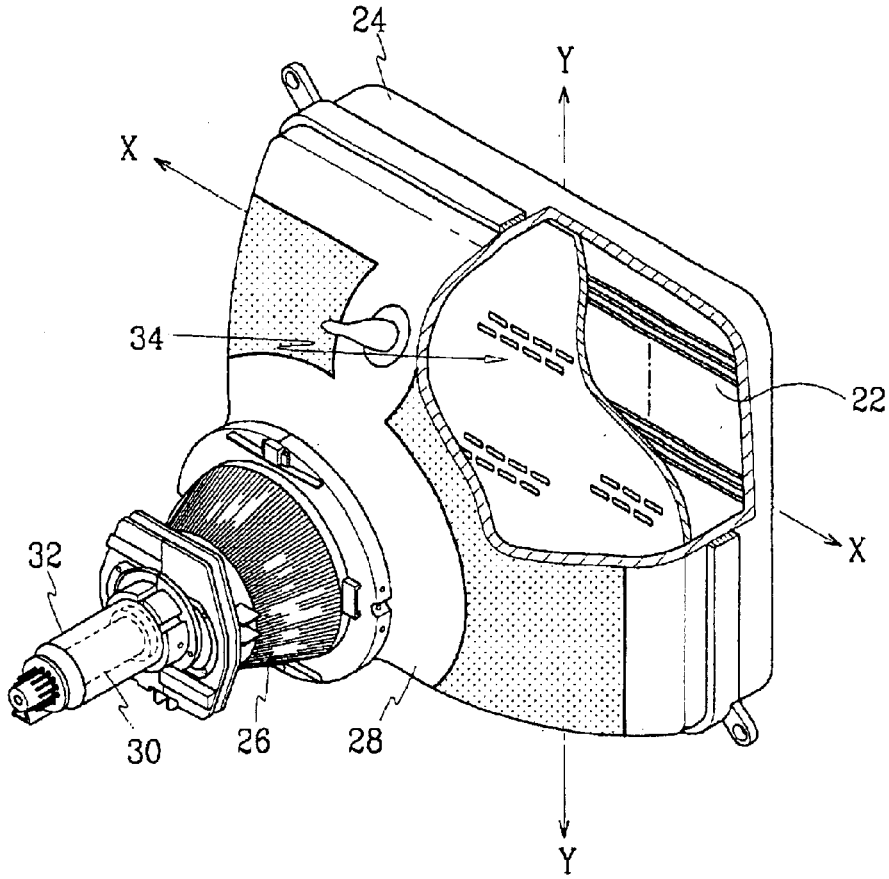
FIG. 1 is a partial sectional view of a cathode ray tube with a color selection apparatus according to a preferred embodiment of the present invention.

FIG. 1 is a partial sectional perspective view of a cathode ray tube with a color selection apparatus according to a preferred embodiment of the present invention.

The cathode ray tube includes a panel 24 with an inner phosphor screen 22, a funnel 28 connected to the panel 24 while externally mounting a deflection unit 26, and a neck 32 connected to the funnel 28 while internally mounting an electron gun 30. The electron gun 30 emits a plurality of RGB (red, green, blue) electron beams such that they land on the phosphor screen 22.

The panel 24 has a flat outer surface and a curved inner surface. A color selection apparatus 34 is mounted within the panel 24 to make the desired color selection function with respect to the electron beams.

The panel 24 is substantially rectangular-shaped such that it has a long axis (indicated in the drawing by the X—X line) and a short axis (indicated by the Y—Y line). The phosphor screen 22 has the same outline as the panel 24.

Figure 2:
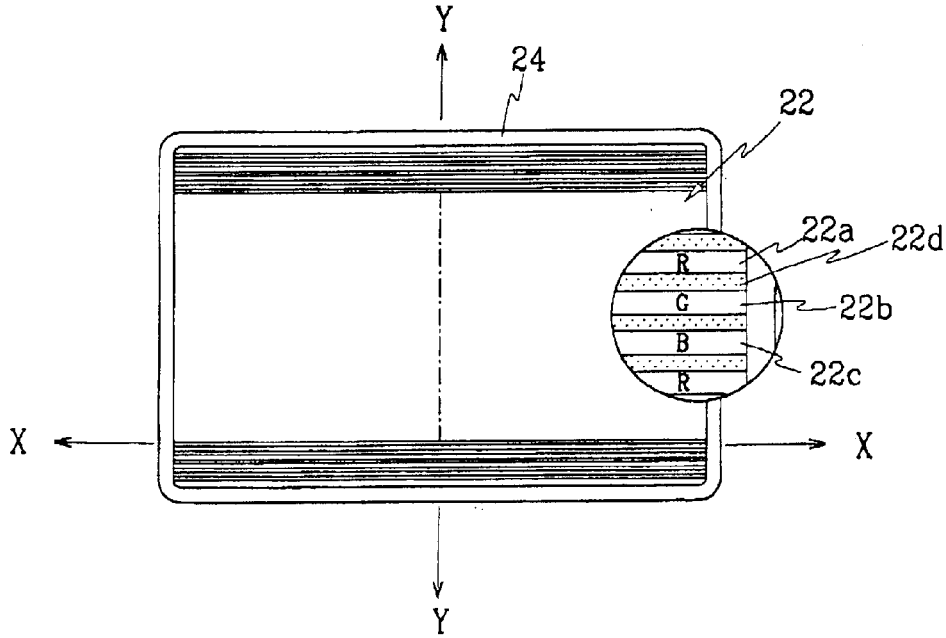
FIG. 2 illustrates the pattern of a phosphor screen for the cathode ray tube shown in FIG. 1.

As shown in FIG. 2, the phosphor screen 22 includes R (red),G (green) and B (blue) phosphors 22*a*, 22*b* and 22*c*, respectively, spaced apart from each other by a predetermined distance, and a black matrix 22*d* disposed between the neighboring phosphors. The R, G, B phosphors 22*a*, 22*b* and 22*c*, respectively, are longitudinally arranged at the inner surface of the panel 24 in the long axis (X—X) direction (or in the horizontal direction). The black matrix 22*d* also proceeds longitudinally in the long axis direction.

Figure 3:
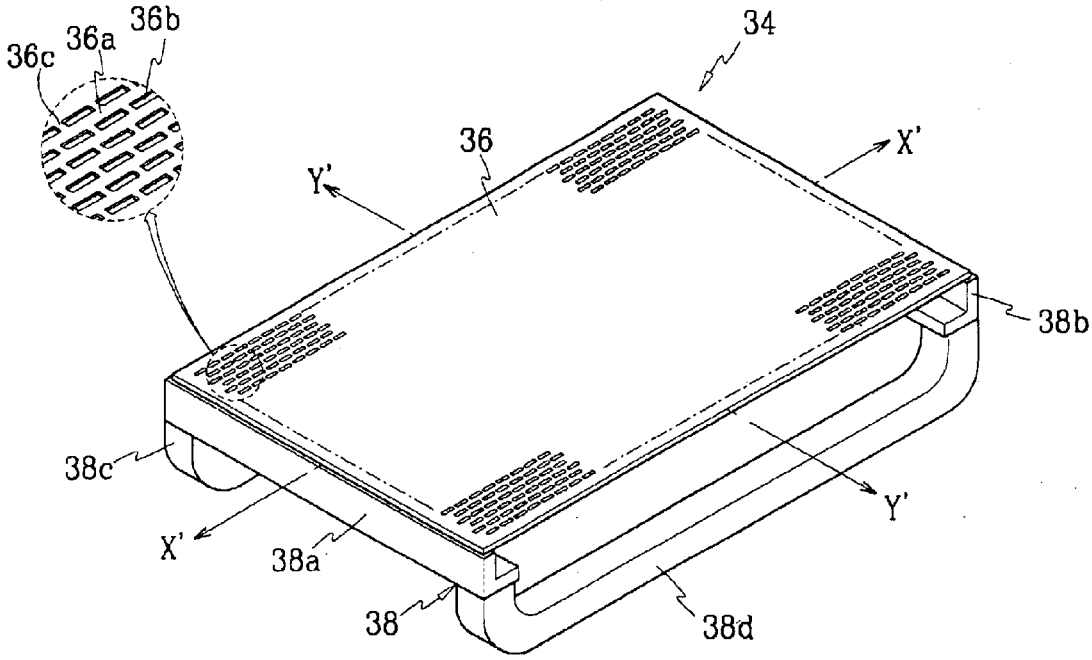
FIG. 3 is an amplified perspective view of the color selection apparatus shown in FIG. 1.

FIG. 3 is an enlarged perspective view of the color selection apparatus 34. As shown in FIG. 3, the color selection apparatus 34 has a rectangular-shaped mask 36 with a long axis (indicated by the X'–X' line) and a short axis (indicated by the Y'–Y' line), and a frame 38. The mask 36 is fitted to the frame 38 while being tensioned in the X'–X' direction (or in the horizontal direction).

The frame 38 has a pair of supporting members 38*a* and 38*b* as well as a pair of elastic members 38*c* and 38*d*. The supporting members 38*a* and 38*b* are formed in the shape of a capital letter L while bearing having a curved surface contacting the mask 36 such that the mask 36 can have a curvature corresponding to the inner curvature of the panel 24. The elastic members 38*c* and 38*d* are formed in the shape of a capital letter U. The shape of the supporting members 38*a* and 38*b* as well as that of the elastic members 38*c* and 38*d* may be varied while making other necessary variations.

In the fabrication process of the color selection apparatus, the supporting members 38*a* and 38*b* are arranged in parallel such that they are spaced apart from each other by a predetermined distance, and the elastic members 38*c* and 38*d* are welded to the same-sided ends of the supporting members 38*a* and 38*b*, respectively. The mask 36 is mounted on the supporting members 38*a* and 38*b* such that it is tensioned in the X'—X' direction.

The mask 36 is formed with a thin metal plate having a thickness of 0.1 mm or more. As shown in the drawing, the mask 36 is formed with a plurality of strips 36*a* spaced apart from each other by a predetermined distance, and a plurality of beam-guide holes 36*b* disposed between the neighboring strips 36*a* with a predetermined pitch.

The strips 36*a* are arranged in the X'—X' direction, and real bridges 36*c* are disposed between the beam-guide holes 36*b* in the X'—X' direction while interconnecting them. Each beam-guide hole 36*b* is formed as a rectangular-shaped slot.

The mask 36 is tensioned in the X'—X' direction, and the beam-guide holes 36*b* are elongated in that direction such that the mask pattern is adapted to the pattern of the phosphor screen 22. It is preferable that the tensional strength of the mask 36 at the periphery thereof is established to be higher than that at the center thereof.

Figure 4:
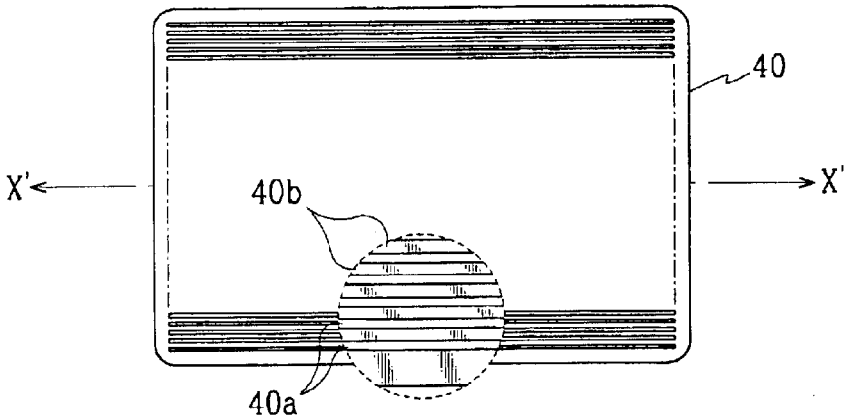
FIGS. 4 and 5 illustrate the available patterns of beam-guide holes of a mask for the cathode ray tube shown in FIG. 1.

The beam-guide holes 36*b* of the mask 36 may be differentiated in shape. For instance, as shown in FIG. 4, the beam-guide hole 40*a* of the mask 40 may be a single slot placed between the neighboring strips 40*b* while being elongated in the X'—X' direction.

Figure 5:
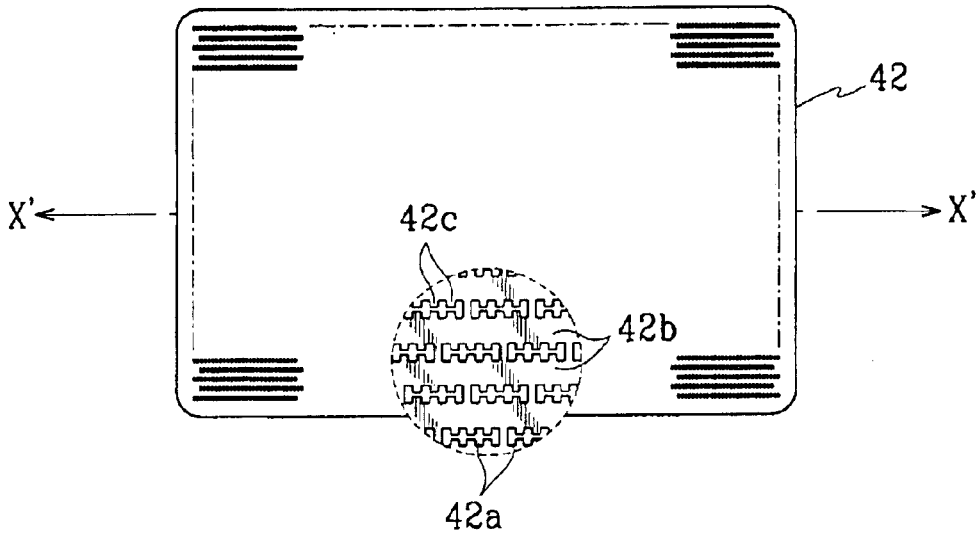

Furthermore, as shown in FIG. 5, it is possible for the beam-guide hole 42*a* of the mask 42 to have the same shape as the above-identified beam-guide hole 36*b*, and dummy bridges 42*c* are formed within the beam-guide hole 42*a* while being extended from the strips 42*b* in a body.

In the above structure, when the R, G, B electron beams land on the relevant phosphors 22*a*, 22*b* and 22*c* at the periphery of the phosphor screen 22 via the color selection apparatus, possible mis-landing of the electron beams due to the terrestrial magnetism can be prevented in an effective manner.

In operation, the electron beams landing on the periphery of the phosphor screen 22 are influenced by the vertical magnetic field component of the terrestrial magnetism, and displaced from the correct landing positions in the long axis direction (or in the horizontal direction). Nevertheless, as the phosphors of the same color are patterned at the phosphor screen 22 in the long axis direction, the displaced electron beams strike the phosphors of the relevant colors, and do not induce any significant problem in the picture quality.

Of course, the electron beams are also influenced by the horizontal magnetic field component of the terrestrial magnetism so that they are displaced from their correct landing positions in the short axis direction. However, the horizontal magnetic field component of the terrestrial magnetism may be disregarded compared to the vertical magnetic field thereof so that it does not affect the vertical displacement of the electron beams in any significant manner. Even though the vertical displacement of the electron beams is made at some degree, the displaced electron beams land on the black matrix 22*d* disposed between the neighboring phosphors in the vertical direction while not hitting the undesired phosphors.

It was confirmed through several experiments that, with the inventive cathode ray tube, the miss-landing of the electron beams on the periphery of the phosphor screen was reduced by 25% compared to the conventional cathode ray tube.

Figure 6:
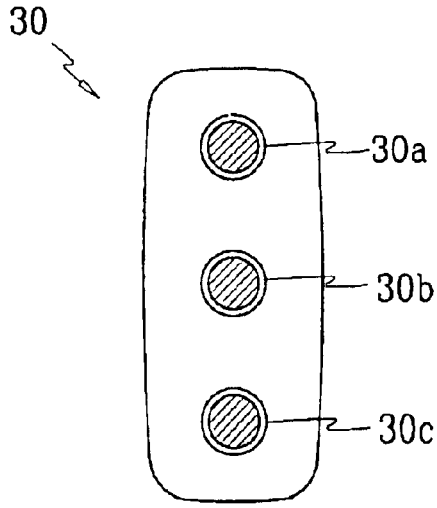
FIG. 6 is a schematic view of an electron gun for the cathode ray tube shown in FIG. 1.

Furthermore, the electron gun 30 may be structured so that the electron beams thereof are directed toward the phosphor screen in a line while being parallel to the short axis of the phosphor screen. For that purpose, as shown in FIG. 6, cathodes 30*a*, 30*b* and 30*c* coated with electron beam emission materials are arranged in a line while not being parallel to the long axis direction, but they are parallel to the short axis direction, thereby forming the plurality of electron beams. Of course, other components of the electron gun 30 should be controlled in an appropriate manner.

Meanwhile, as the cathode ray tube is formed with a completely flattened panel 24, it is liable to suffer from an explosion depending upon the distribution of the stresses applied to the panel 24. Furthermore, such a cathode ray tube may involve an increase in weight so as to make them inconvenient to carry. In order to avoid such problems, the panel 24 is structured to be well adapted to the structure of the phosphor screen 22 and the color selection apparatus 34.

Figure 7:
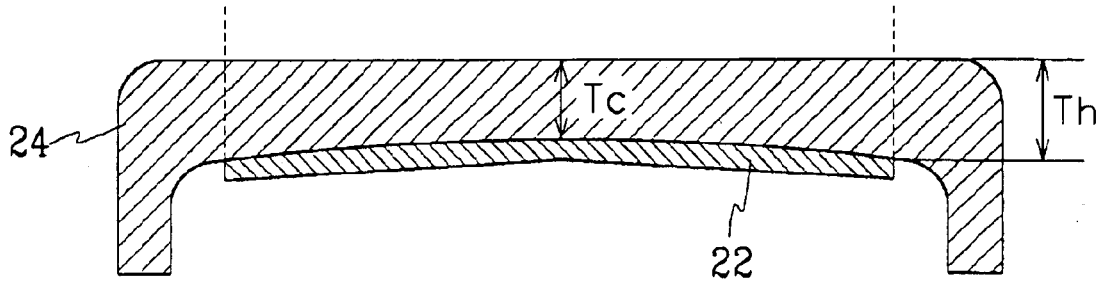
FIG. 7 is a cross sectional view of a panel for the cathode ray tube shown in FIG. 1 taken along the long axis thereof.
Figure 8:
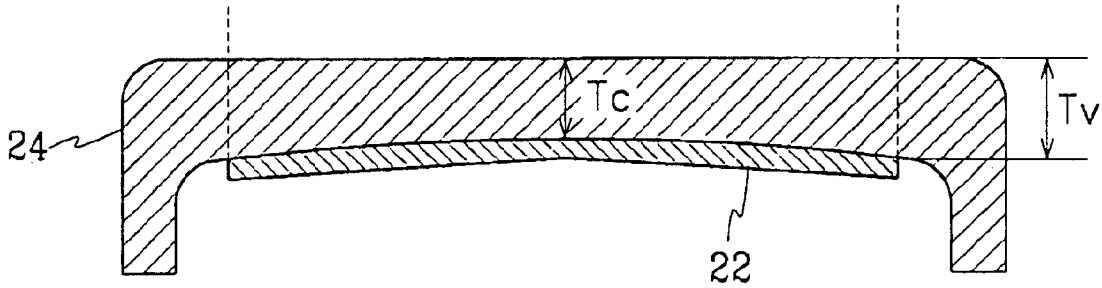
FIG. 8 is a cross sectional view of a panel for the cathode ray tube shown in FIG. 1 taken along the short axis thereof.
Figure 9:
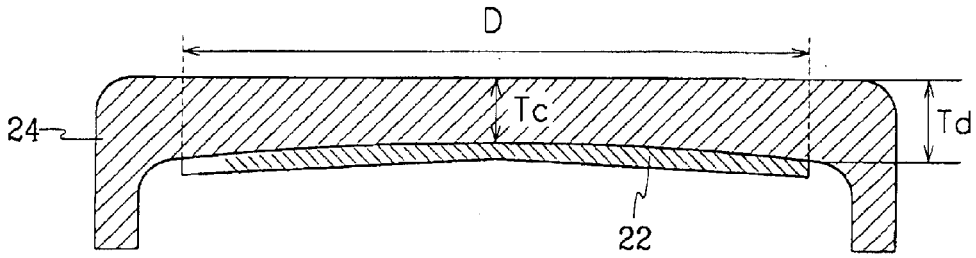
FIG. 9 is a cross sectional view of a panel for the cathode ray tube shown in FIG. 1 taken along the diagonal axis thereof.
Figure 10:
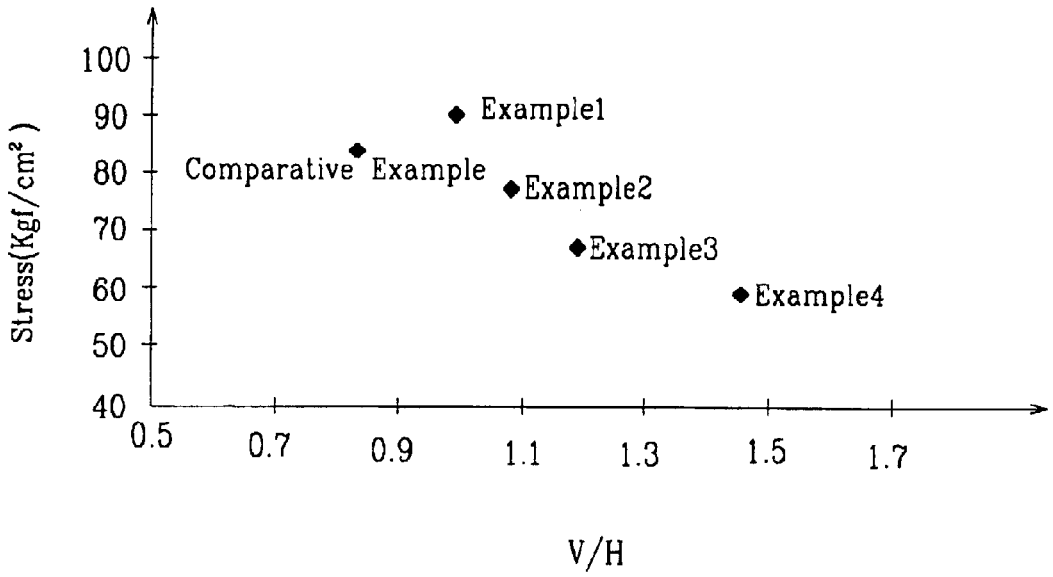
FIG. 10 is a graph illustrating the stress distribution, and the horizontal and vertical wedge rates, of a panel for the cathode ray tube shown in FIG. 1.

The panel 24 bears arbitrary thickness distribution in various directions. FIG. 7 illustrates the thickness distribution of the panel in the long axis direction. FIG. 8 illustrates the thickness distribution in the short axis direction. FIG. 9 illustrates the thickness distribution in the diagonal direction.

As shown in the drawings, the panel 24 bears an effective screen area where the phosphor screen is positioned. The panel 24 has a first thickness Tc at the center of the effective screen, a second thickness Th at the horizontal ends of the effective screen, a third thickness Tv at the vertical ends of the effective screen, and a fourth thickness Td at the diagonal ends of the effective screen. The aspect ratio of the effective screen is established to be 4:3, and the diagonal length D thereof to be 23 inches or less.

The third thickness Tv of the panel 24 is established to be larger than the second thickness Th thereof while satisfying the following condition: $V/H \geqq 1.1$ where V (%) is $(Tv/Tc)\times 100$, and H (%) is $(Th/Tc)\times 100$. The value of V or H will be called the "wedge rate." This condition is made such that the degree of stress applied to the panel 24 is reduced while preventing explosion of the cathode ray tube.

Table 1 lists the results of comparing the panel bearing the above condition and the conventional panel.

TABLE 1

| | Direction of tension application to mask | Central thickness of panel (Tc) | Wedge rate H | Wedge rate V | Wedge rate D | Stress (Long side of panel) |
|---|---|---|---|---|---|---|
| Comparative Example | Short axis | 13.5 mm | 123% | 100.5% | 122.2% | 84.3 kgf/cm$^2$ |
| Example 1 | Long axis | 13.5 mm | 100.5% | 100.6% | 123% | 89.2 kgf/cm$^2$ |
| Example 2 | Long axis | 13.5 mm | 100.5% | 110.2% | 123% | 76.5 kgf/cm$^2$ |
| Example 3 | Long axis | 13.5 mm | 100.5% | 123% | 123% | 66.5 kgf/cm$^2$ |
| Example 4 | Long axis | 13.5 | 100.5% | 150% | 147% | 58.3 kgf/cm$^2$ |

In the Comparative Example, the tension was applied to the mask in the short axis direction, the value of V/H was 0.82, and the stress applied to the long side of the panel was 84.3 kgf/cm$^2$.

By contrast, in the Example 1 where the value of V/H was 1.001, the stress of 89.2 kgf/cm$^2$ was applied to the long side of the panel, and this stress value is too great to obtain the stability of the panel.

In the Examples 2, 3 and 4 where the value of V/H was 1.1 or more, the stress applied to the panel was diminished so much that possible explosion thereof due to the stress application can be prevented.

As described above, the panel 24 is structured to be adapted to the structure of the mask 36 of the color selection apparatus 34. That is, the third thickness Tv of the panel at the ends of the effective screen in the short axis direction is established to be larger than the third thickness Th thereof in the long axis direction, while the value of V/H is established to be 1.1 or more. In this way, possible explosion of the panel due to the stress application can be prevented.

Furthermore, in the above structure, the panel bears reduced weight so that the total weight of the resulting cathode ray tube can be decreased. This can be discriminated from Table 2.

TABLE 2

| | Direction of tension application to mask | Central thickness of panel (Tc) | Stress (Long side of panel) | Weight of panel |
|---|---|---|---|---|
| Prior art | Short axis | 13.5 | 84.3 kgf/cm$^2$ | 11.18 kg |
| Present invention | Long axis | 12.3 | 84.1 kgf/cm$^2$ | 10.6 kg |

As described above, with the inventive cathode ray tube, mis-landing of the electron beams due to the terrestrial magnetism can be reduced while preventing occurrence of color spots. Furthermore, possible explosion of the flat panel due to the stress application can be prevented.

While the present invention has been illustrated by the description of embodiments thereof, and while the embodiments have been described in considerable detail, it is not intended to restrict or in any way limit the scope of the appended claims to such detail. Additional advantages and modifications will readily appear to those skilled in the art. Therefore, the invention in its aspects is not limited to the specific details, representative apparatus and method, and illustrative examples shown and described. Accordingly, departures may be made from such details without departing from the spirit or scope of the general inventive concept.

What is claimed is:

1. A color selection apparatus for a cathode ray tube, the color selection apparatus comprising:

a mask having a short axis and a long axis, the mask being provided with a plurality of beam-guide holes; and a frame combined with the mask such that the mask is kept in a tensioned state, wherein the mask is tensioned in a direction of the long axis while being supported by the frame; and wherein said mask comprises a plurality of strips extending in a direction of the long axis and spaced apart from each other by a predetermined distance, beam guide holes arranged in a plurality of lines extending in the direction of the long axis, each line of said beam guide holes being disposed between a respective pair of said strips immediately adjacent to said each line of said beam guide holes, and real bridges disposed between each of said strips, each of said real bridges being disposed alone one of the lines of said beam guide holes and between a respective pair of immediately adjacent beam guide holes in said one of the lines of said beam guide holes.

2. The color selection apparatus of claim 1, wherein the frame comprises a pair of supporting members fitted to the mask and arranged parallel to each other, and a pair of elastic members fitted to the supporting members and disposed in parallel between the supporting members so as to maintain a constantly tensioned state of the mask.

3. The color selection apparatus of claim 2, wherein a side of the supporting member contacting the mask is curved in accordance with a predetermined curvature.

4. A cathode ray tube, comprising:

a panel having a substantially flat outer surface and an inner curved surface, the inner curved surface of the panel including a phosphor screen;

a funnel connected to the panel while externally mounting a deflection unit for deflecting electron beams;

a neck connected to the funnel while internally mounting an electron gun for emitting the electron beams; and a color selection apparatus internally fitted to the panel such that the electron beams land on correct phosphors of the phosphor screen;

wherein the panel includes an effective screen with a short axis and a long axis while having a first thickness Th at ends of the effective screen in a direction of the long axis and a second thickness Tv at the ends of the effective screen in a direction of the short axis, the second thickness Tv being larger than the first thickness Th; and wherein the color selection apparatus includes a mask having a short axis and a long axis while having a plurality of beam-guide holes, and a frame combined with the mask such that the mask maintains a tensioned state, the mask being tensioned in the direction of the long axis while being supported by the frame.

5. The cathode ray tube of claim 4, wherein the panel has a third thickness Tc at the center of the effective screen while satisfying the following condition: $V/H \geqq 1.1$ where V(%) is $(Tv/Tc)\times 100$, and H(%) is $(Th/Tc)\times 100$.

6. The cathode ray tube of claim 4, wherein the effective screen has an aspect ratio of 4:3.

7. The cathode ray tube of claim 4, wherein the panel has a diagonal axis, and a length L of the panel in a direction of the diagonal axis is no greater than 23 inches.

8. A cathode ray tube, comprising:

a panel having a substantially flat outer surface and an inner curved surface, the inner curved surface of the panel including a phosphor screen;

a funnel connected to the panel while externally mounting a deflection unit for deflecting electron beams;

a neck connected to the funnel while internally mounting an electron gun for emitting the electron beams; and a color selection apparatus internally fitted to the panel such that the electron beams land on correct phosphors of the phosphor screen;

wherein the phosphor screen is shaped so as to have a short axis and a long axis, and phosphors are longitudinally arranged on the phosphor screen in a direction of the long axis;

wherein the color selection apparatus includes a mask having a plurality of beam-guide holes corresponding to the phosphors, and a frame combined with the mask and accommodating the mask being tensioned in the direction of the long axis; and wherein the electron beams emitted by the electron gun are directed toward the phosphor screen in a line while being parallel to the short axis of the phosphor screen;

said panel including an effective screen having a short axis and a long axis, wherein a first thickness at ends of the effective screen in the direction of the long axis is less than a second thickness at ends of the effective screen in the direction of the short axis.

9. The cathode ray tube of claim 8, wherein a ratio of the second thickness to the first thickness is at least 1.1.

10. The cathode ray tube of claim 9, wherein a tensional strength of a periphery of the mask is greater than a tensional strength at a center of the mask.

* * * * *